US010501295B2

(12) United States Patent
Eeshan

(10) Patent No.: US 10,501,295 B2
(45) Date of Patent: Dec. 10, 2019

(54) LIFTING JACK FOR AUTOMOTIVE

(71) Applicants: Hyundai Motor Company, Seoul (KR); Kia Motors Corporation, Seoul (KR)

(72) Inventor: Geel Eeshan, Hyderabad (IN)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 202 days.

(21) Appl. No.: 15/851,208

(22) Filed: Dec. 21, 2017

(65) Prior Publication Data

US 2019/0127191 A1 May 2, 2019

(30) Foreign Application Priority Data

Oct. 31, 2017 (IN) ..... 201711038720

(51) Int. Cl.
*B66F 3/12* (2006.01)
*B66F 3/22* (2006.01)
*B66F 3/08* (2006.01)

(52) U.S. Cl.
CPC ..... *B66F 3/12* (2013.01); *B66F 3/08* (2013.01); *B66F 3/22* (2013.01)

(58) Field of Classification Search
CPC ..... B66F 3/00; B66F 3/08; B66F 3/12; B66F 3/22
See application file for complete search history.

(56) References Cited

U.S. PATENT DOCUMENTS 1,774,926 A * 9/1930 Mads ..... B60S 9/04 254/126
1,859,994 A * 5/1932 Sessions ..... B66F 3/12 254/126
1,888,761 A * 11/1932 Foyer ..... B60S 9/04 254/126
2,557,465 A * 6/1951 Rauscher, Sr. ..... B66F 3/12 254/122
3,096,967 A * 7/1963 Duke ..... B66F 3/12 254/126
4,092,012 A * 5/1978 Ishigami ..... B66F 3/12 254/126
4,509,724 A * 4/1985 Okada ..... B66F 3/12 254/126
4,583,713 A * 4/1986 Fukura ..... B66F 3/12 254/126

(Continued)

*Primary Examiner* — Tyrone V Hall, Jr.
(74) *Attorney, Agent, or Firm* — Morgan, Lewis & Bockius LLP

(57) ABSTRACT

A lifting jack for automotive may include a base; a pair of lower arms of which one end portion is hingedly engaged with both sides of the base; a stand having a stand groove; a pair of upper arms of which one end portion is hingedly engaged with both sides of the stand and the other end portion is hinge is hingedly engaged with the other end portion of the pair of lower arms; a fix bracket hingedly engaged with the other end portion of the lower arm and the other end portion of the upper arm; a hollow screw rod penetrating and being inserted into the fix bracket and screw threads are provided on an external circumference; a connection shaft inserted into an internal circumference of the screw rod; and a key inserted into the screw rod through the fix bracket.

15 Claims, 18 Drawing Sheets

(56) References Cited

U.S. PATENT DOCUMENTS

| | | | | | |
|---|---|---|---|---|---|
| 4,720,082 | A * | 1/1988 | Yang | B66F 3/12 | 254/122 |
| 5,970,812 | A * | 10/1999 | Fan | B23Q 5/408 | 269/181 |
| 6,799,749 | B1 * | 10/2004 | Voegeli, Jr. | B66F 3/12 | 254/126 |
| 8,123,180 | B2 * | 2/2012 | Shipman | F16M 11/10 | 248/178.1 |

* cited by examiner

LIFTING JACK FOR AUTOMOTIVE

CROSS-REFERENCE TO RELATED APPLICATION

The present application claims priority to Indian Patent Application No. 201711038720 filed in the Indian Patent Office on Oct. 31, 2017, the entire contents of which is incorporated herein for all purposes by this reference.

BACKGROUND OF THE INVENTION

Field of the Invention

The present invention relates to a lifting jack for automotive. More particularly, the present invention relates to a lifting jack for automotive which is used when the automotive is lifted for changing a flat tire.

Description of Related Art

Generally, in a trunk compartment of the automotive, a lifting jack for automotive is stored which lifts the automotive in a certain height for changing or repairing a tire. The lifting jack performs lifting the automotive in a vertical direction as load is applied to the automotive in a vertical direction thereof.

Referring to FIG. 1 illustrating a conventional lifting jack for automotive performing the above function, the lifting jack 10 for automotive includes a supporter 20 supporting a vehicle body, a base 30 supported by ground, and a connection frame 50 which ascends and descends according to a screw rod provided between the supporter and the base.

The screw rod 40 has to rotate for ascending and descending of the connection frame 50. By the way, the connection frame 50 of the conventional lifting jack 10 ascend and descend only by the rotation of the screw rod 40, therefore it is required a lot of time and effort to rotate the screw rod 40.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a lifting jack for automotive which includes a connection shaft and a key slidably inserted respectively into both sides of a screw rod to be combined and released so that may ascend and descend the automotive by less effort and time.

A lifting jack for automotive according to an exemplary embodiment of the present invention includes a base; a pair of lower arms of which one end portion is hingedly engaged with both sides of the base; a stand having a stand groove; a pair of upper arms of which one end portion is hingedly engaged with both sides of the stand and the other end portion is hinge is hingedly engaged with the other end portion of the pair of lower arms; a fix bracket hingedly engaged with the other end portion of the lower arm and the other end portion of the upper arm; a hollow screw rod penetrating and being inserted into the fix bracket and screw threads are provided on an external circumference; a connection shaft inserted into an internal circumference of the screw rod; and a key inserted into the screw rod through the fix bracket so that the connection shaft is inserted into and fixed at the internal circumference of the screw rod.

The other end portion of the pair of lower arms may be hingedly engaged with an external side of the other end portion of the pair of upper arms.

The fix bracket may be hingedly engaged with an internal side of one of the pair of upper arms.

Screw grooves may be provided at the internal circumference of the screw rod.

Shaft protrusions engaged with the screw grooves may be provided at an external circumference of the connection shaft.

The connection shaft may rotate in a direction which is vertical to lengthwise direction of the connection shaft so that the screw grooves and the shaft protrusions are engaged with each other.

Key protrusions may be provided at an external circumference of the key, and the key protrusions may be inserted between and engaged with the shaft protrusions.

The key may be inserted into the screw rod through the fix bracket in state that the key rotates in a direction vertical to a lengthwise direction of the connection shaft and the screw grooves and the shaft protrusions may be engaged with each other.

The base and the stand may be remote from each other by rotating the connection shaft in an opposite direction to rotation direction which the screw grooves and the shaft protrusions are engaged with each other.

The base and the stand may be remote from each other by rotating the key in an opposite direction to rotation direction which the screw grooves and the shaft protrusions are engaged with each other.

A connection shaft hole may be provided at an end portion of the connection shaft in an opposite direction of the direction which the connection shaft is inserted into the internal surface of the screw rod.

The connection shaft may rotate by inserting a wrench into the connection shaft hole and rotating the wrench.

A key hole may be provided at an end portion of the key in an opposite direction of the direction which the key is inserted into the screw rod.

The key may rotate by inserting a wrench into the key hole and rotating the wrench.

The key hole and the fix bracket may be connected to each other by a chain.

According to an exemplary embodiment of the present invention, a lifting jack for automotive which may ascend and descend the automotive by less effort and time.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
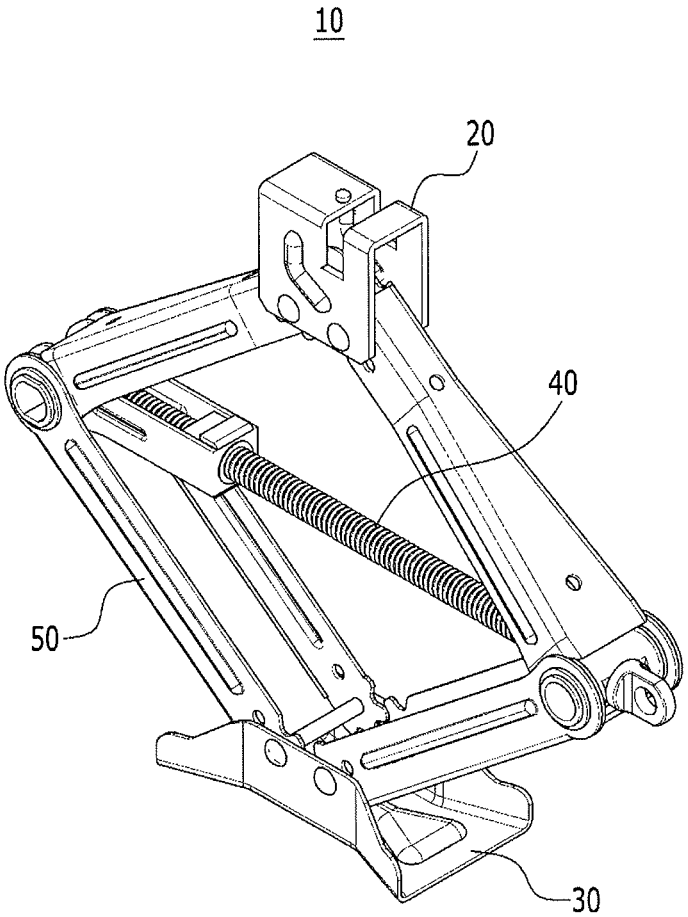
FIG. 1 (Prior art)
FIG. 1 is a schematic view illustrating a conventional lifting jack for automotive.

It may be understood that the appended drawings are not necessarily to scale, presenting a somewhat simplified representation of various features illustrative of the certain principles of the invention. The specific design features of the present invention as included herein, including, for example, specific dimensions, orientations, locations, and shapes will be determined in part by the intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Further, in exemplary embodiments, since like reference numerals designate like elements having the same configuration, various exemplary embodiments is representatively described, and in other exemplary embodiments, only configurations different from the various exemplary embodiments will be described.

The drawings are schematic, and are not illustrated in accordance with a scale. Relative dimensions and ratios of portions in the drawings are illustrated to be exaggerated or reduced in size for clarity and convenience, and the dimensions are just exemplified and are not limiting. In addition, same structures, elements, or components illustrated in two or more drawings use same reference numerals for showing similar features. It will be understood that when an element including a layer, film, region, or substrate is referred to as being "on" another element, it can be directly on the other element or intervening elements may also be present.

The exemplary embodiment of the present invention shows an exemplary embodiment of the present invention in detail. As a result, various modifications of the drawings will be expected. Therefore, the exemplary embodiment is not limited to a specific aspect of the illustrated region, and for example, includes modifications of an aspect by manufacturing.

Now, a lifting jack for automotive according to an exemplary embodiment of the present invention will be described with reference to FIG. 1, FIG. 2, FIG. 3, and FIG. 4.

Figure 2:
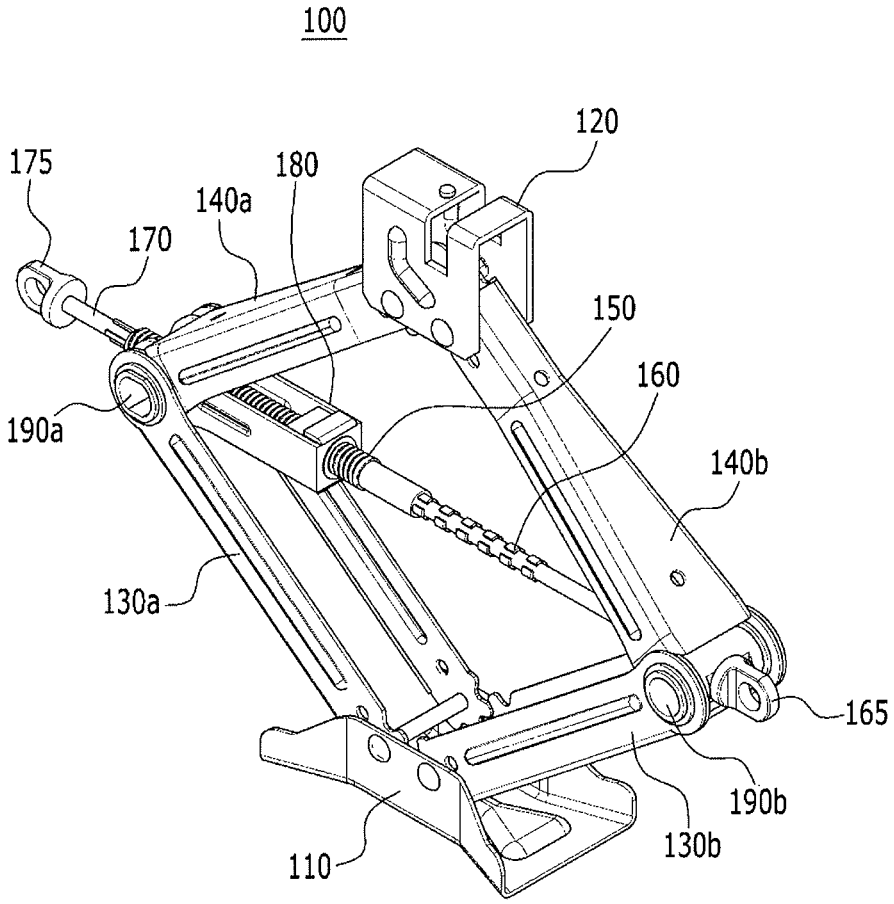
FIG. 2 is a schematic view illustrating a lifting jack for automotive according to an exemplary embodiment of the present invention.
Figure 3:
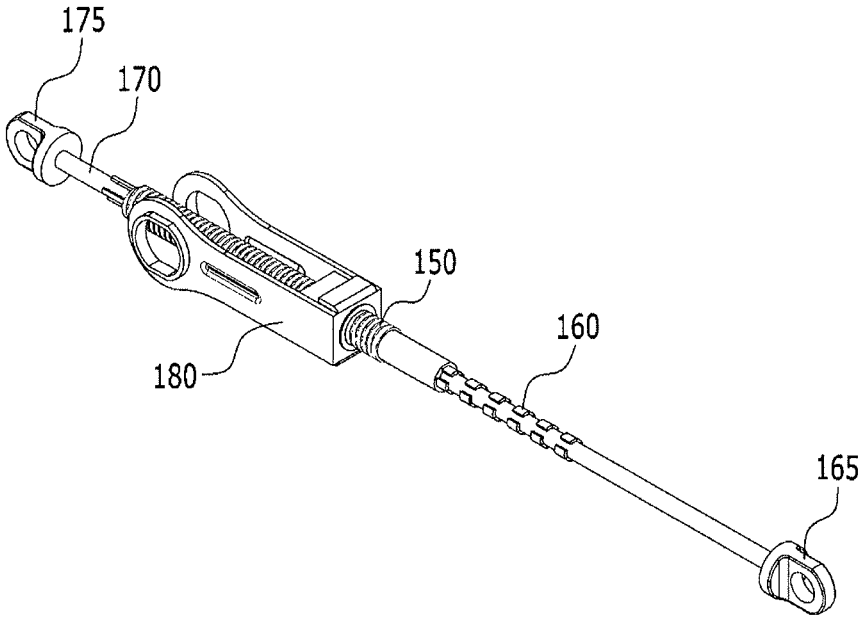
FIG. 3 is a drawing illustrating a state that a screw rod, a connection shaft and a key are engaged with a fix bracket of the lifting jack for automotive according to an exemplary embodiment of the present invention.
Figure 4:
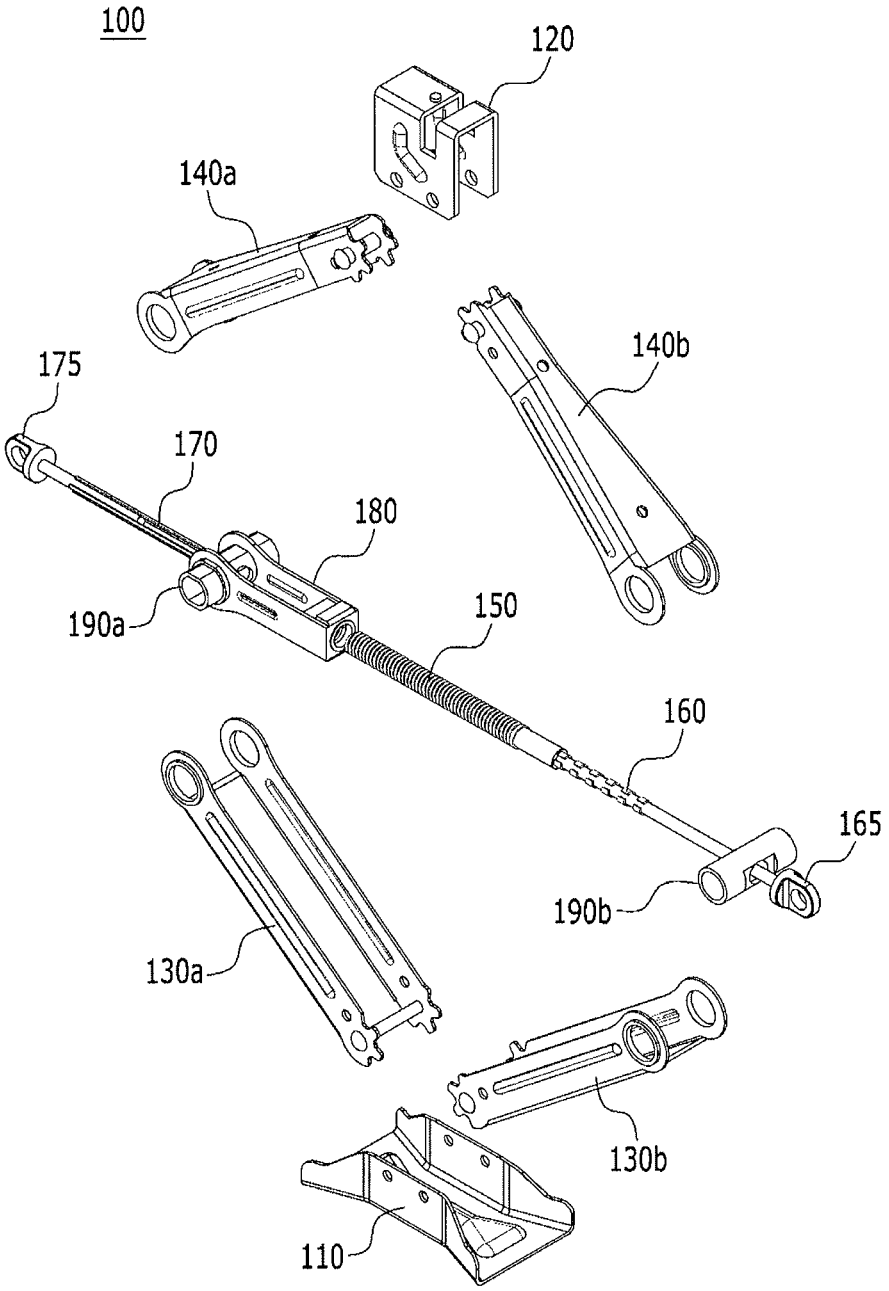
FIG. 4 is an exploded perspective view of the lifting jack for automotive according to an exemplary embodiment of the present invention.

FIG. 2 is a schematic view illustrating a lifting jack for automotive according to an exemplary embodiment of the present invention, FIG. 3 is a drawing illustrating a state that a screw rod, a connection shaft and a key are engaged with a fix bracket of the lifting jack for automotive according to an exemplary embodiment of the present invention, and FIG. 4 is an exploded perspective view of the lifting jack for automotive according to an exemplary embodiment of the present invention.

Referring to FIG. 2, FIG. 3 and to FIG. 4, A lifting jack 100 for automotive includes a base 110, a pair of lower arms 130*a* and 130*b*, a stand 120, a pair of upper arms 140*a* and 140*b*, a fix bracket 180, a screw rod 150, a connection shaft 160, and a key 170.

The base 110 is disposed at the most lower portion of the lifting jack 100 for automotive, for example, lower surface of the base 110 contacts with ground when the automotive ascend or descend by use of the lifting jack 100 for automotive.

Each one end portion of the pair of lower arms 130*a* and 130*b* is engaged on the base 110 and hingedly engaged with both sides of the base 110 to rotate on the basis of the base 110.

The stand 120 supports bottom part of the automotive, and has a stand groove so that the automotive is fixed on the stand 120. Each one end portion of the pair of upper arms 140*a* and 140*b* is engaged on the stand 120 and hingedly engaged with both sides of the stand 120 to rotate on the basis of the stand 120.

Each other end portion of the pair of upper arms 140*a* and 140*b* is hingedly engaged with each other end portion of the pair of lower arms 130*a* and 130*b* so that the pair of upper arms 140*a* and 140*b* and the pair of lower arms 130*a* and 130*b* may rotate with respect to each other.

The fix bracket 180 is hingedly engaged with the other end portion of the lower arm 130*a* and 130*b* and the other end portion of the upper arm 140*a* and 140*b*. The other end portion of the pair of lower arms 130*a* and 130*b* may be hingedly engaged at outside of the other end portion of the pair of upper arms 140*a* and 140*b*, and the fix bracket 180 may be hingedly engaged at inside of the upper arm 140*a* and 140*b* on a part that the fix bracket 180 is engaged.

The screw rod 150 is hollow, penetrates and is inserted into the fix bracket 180, and screw threads are provided on an external circumference. The screw rod 150 may rotate in a state of being inserted into the fix bracket 180, and the screw threads provided on the external circumference contact with the external circumference of a hole formed at an end portion of the fix bracket 180. As the screw rod 150 rotates, the screw rod 150 enters toward inside or exits from outside of the fix bracket 180.

The connection shaft 160 is inserted into an internal circumference of the screw rod 150. Shaft protrusions 162 are provided at an external circumference of the connection shaft 160 at predetermined intervals. Screw grooves 152 are provided at the internal circumference of the screw rod 150. The connection shaft 160 is inserted into the internal circumference of the screw rod 150, and the shaft protrusions 162 may be engaged with the screw grooves 152 of the screw rod 150.

The key 170 is inserted into the screw rod 150 through the fix bracket 180. The connection shaft 160 is inserted into and fixed at the internal circumference of the screw rod 150. In a state that the connection shaft 160 is inserted into the internal circumference of the screw rod 150, the key 170 is inserted into the screw rod 150 so that the connection shaft 160 and the screw rod 150 are engaged and fixed with each other.

Figure 5A:
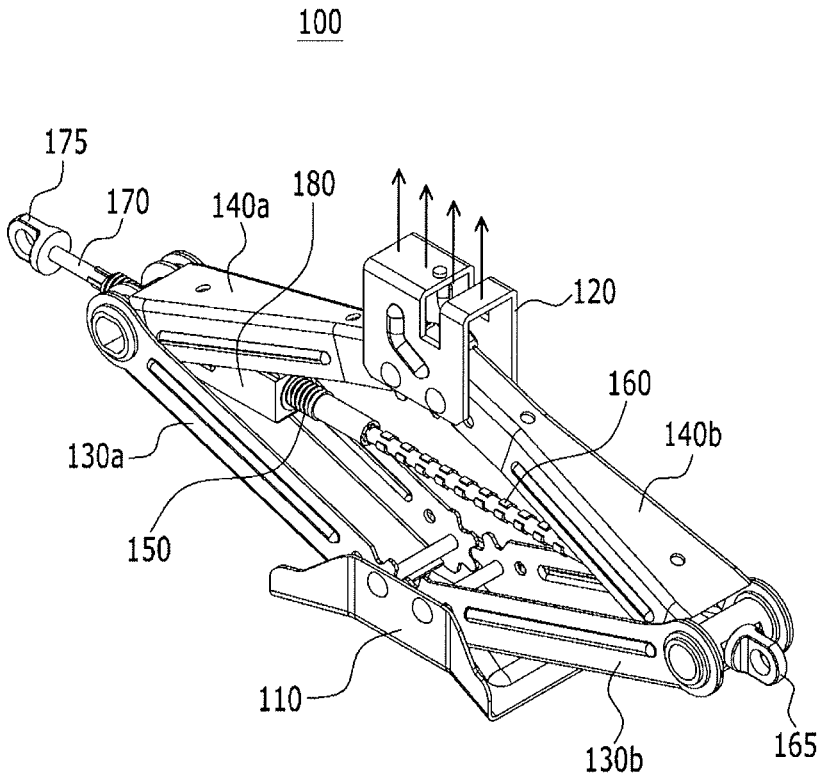
FIG. 5A is a drawing illustrating a state that the connection shaft of the lifting jack for automotive according to an exemplary embodiment of the present invention is inserted into the screw rod to lift the automotive.
Figure 5B:
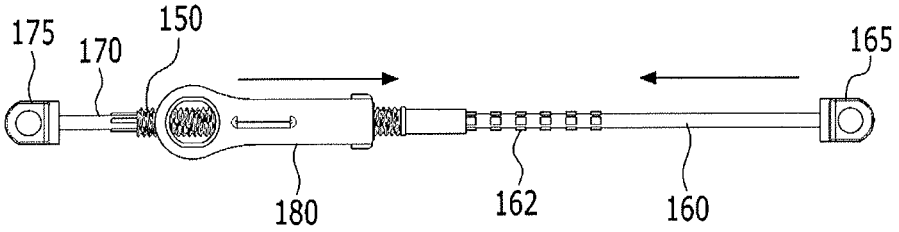
FIG. 5B is a drawing illustrating a state that the connection shaft of the lifting jack for automotive according to an exemplary embodiment of the present invention is inserted into the screw rod.
Figure 5C:
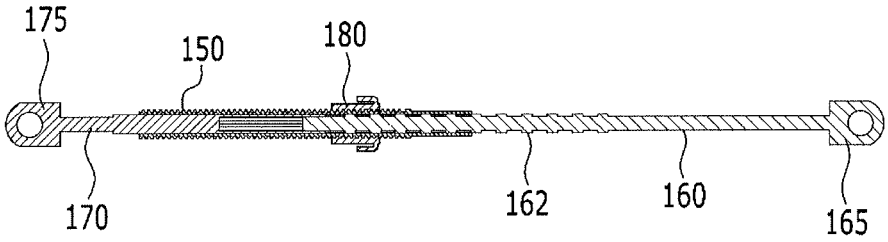
FIG. 5C is a cross-sectional view of FIG. 5B.
Figure 5D:
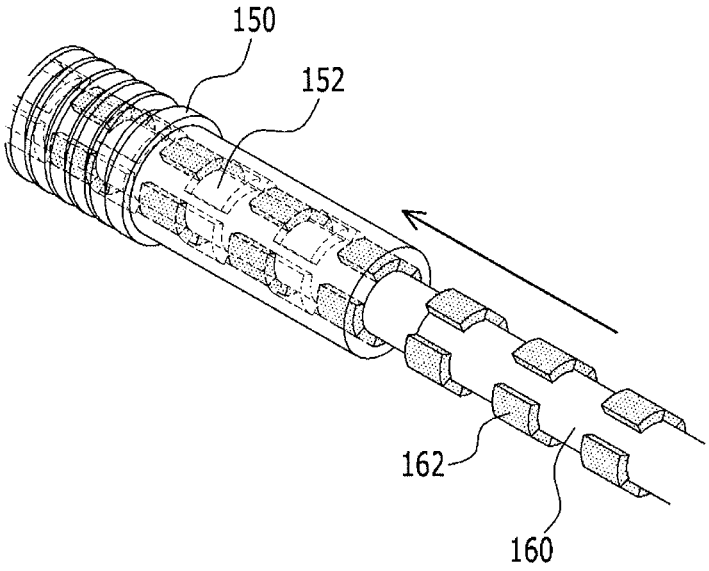
FIG. 5D is an enlarged view illustrating a state that the connection shaft of the lifting jack for automotive according to an exemplary embodiment of the present invention is inserted into the screw rod.

FIG. 5A is a drawing illustrating a state that the connection shaft of the lifting jack for automotive according to an exemplary embodiment of the present invention is inserted into the screw rod to lift the automotive, FIG. 5B is a drawing illustrating a state that the connection shaft of the lifting jack for automotive according to an exemplary embodiment of the present invention is inserted into the screw rod, FIG. 5C is a cross-sectional view of FIG. 5B, and FIG. 5D is an enlarged view illustrating a state that the connection shaft of the lifting jack for automotive according to an exemplary embodiment of the present invention is inserted into the screw rod.

Referring to FIG. 5A, FIG. 5B, FIG. 5C, and FIG. 5D, firstly, the lifting jack 100 for automotive is positioned under the automotive to lift the automotive, and the connection shaft 160 is inserted into the internal circumference of the screw rod 150. Further, a user pulls the stand 120 toward upper portion direction and inserts the connection shaft 160 into the internal circumference of the screw rod 150 in a length as the user would like. According to distance between the bottom surface of the automotive and the ground which the user would like to lift, the length which the user inserts the connection shaft 160 into the internal circumference of the screw rod 150 becomes different. At this time, the more the user inserts the connection shaft 160 into the internal circumference of the screw rod 150, the less effort and time is required to lift the automotive.

The user may pull the stand 120 toward the upper side direction to insert the connection shaft 160 to the internal circumference of the screw rod 150. Also, the user may push the fix bracket 180 toward the connection shaft 160 or push the lower arm 130*a* or the upper arm 140*a* at the side of the fix bracket 180 to insert the connection shaft 160 to the internal circumference of the screw rod 150.

At this time, the shaft protrusions provided at the external circumference of the connection shaft 160 is not engaged with the screw grooves 152 provided at the internal circumference of the screw rod 150.

Figure 6A:
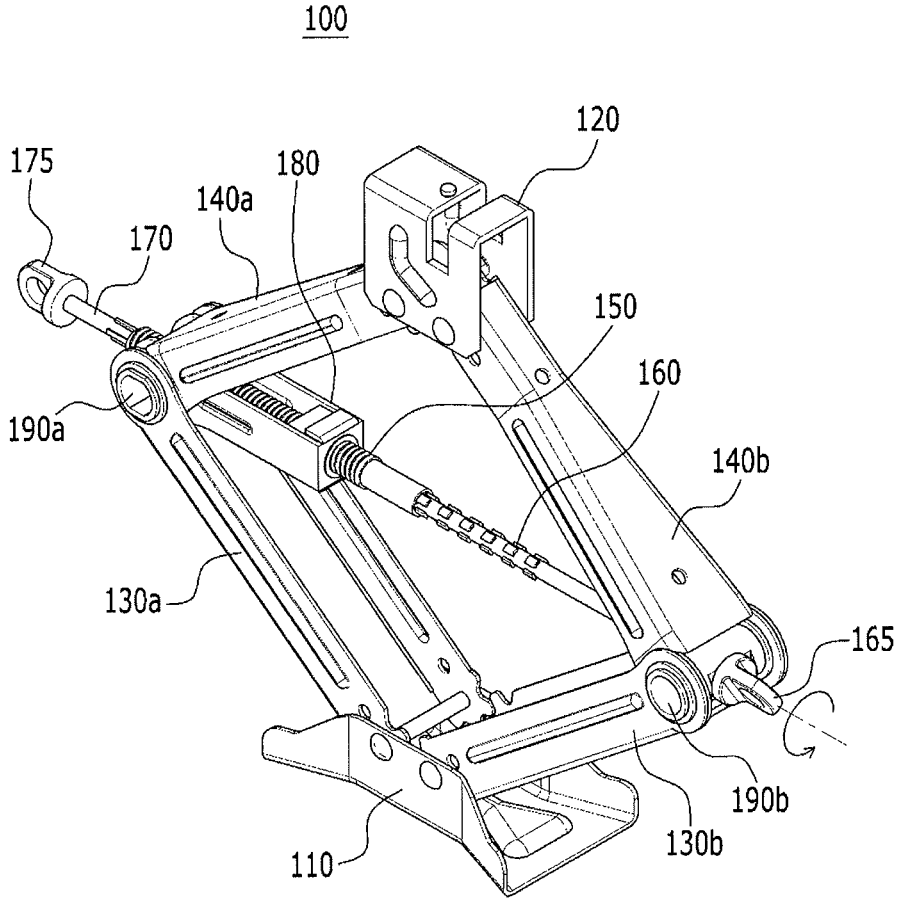
FIG. 6A is an enlarged view illustrating a state that the connection shaft of the lifting jack for automotive according to an exemplary embodiment of the present invention is inserted into the screw rod, and the connection shaft rotates to engage shaft protrusions with screw grooves.
Figure 6B:
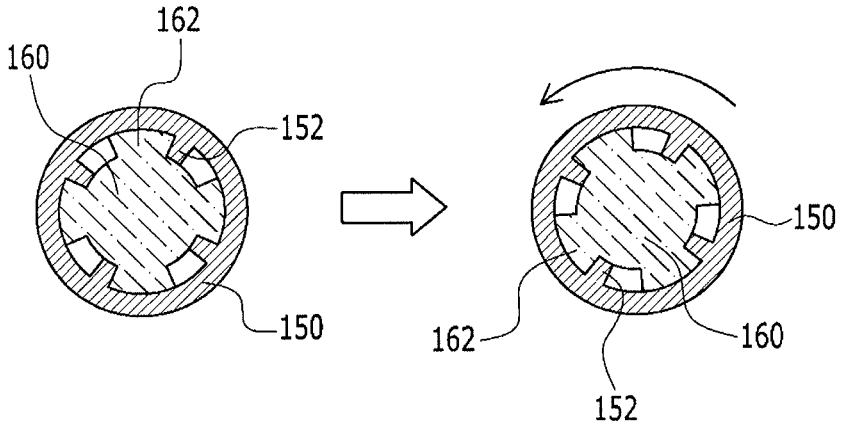
FIG. 6B is a cross-sectional view illustrating a state that the connection shaft of the lifting jack for automotive according to an exemplary embodiment of the present invention is inserted into the screw rod, and the connection shaft rotates to engage shaft protrusions with screw grooves.
Figure 6C:
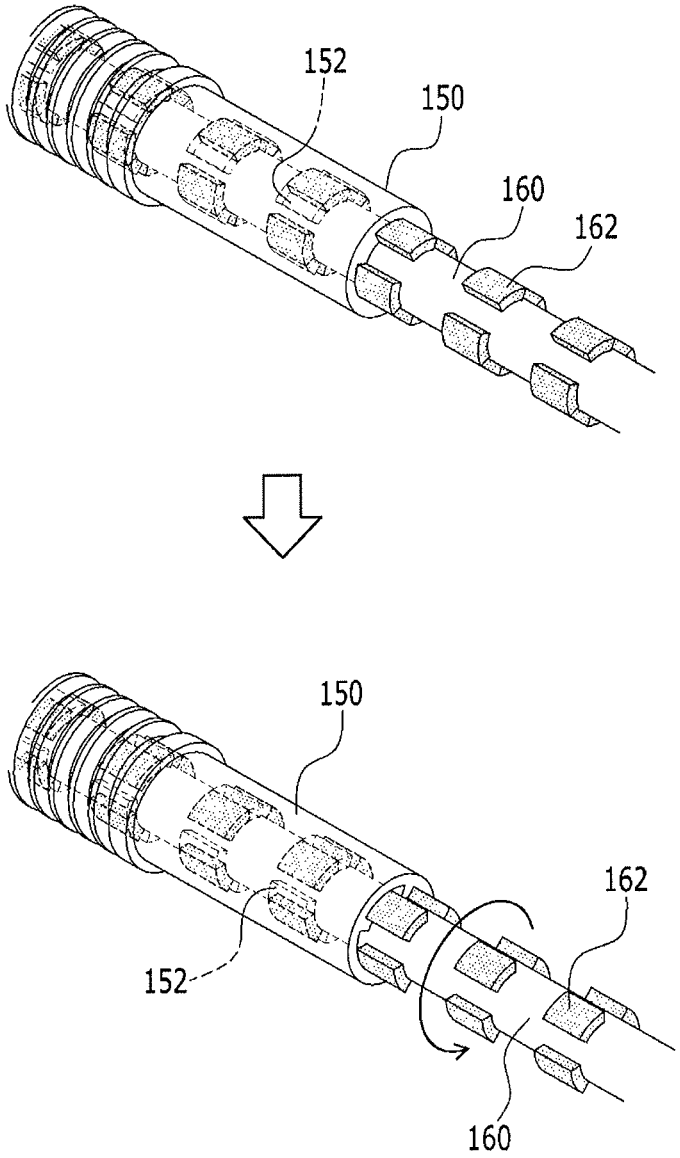
FIG. 6C is an enlarged view illustrating a state that the connection shaft of the lifting jack for automotive according to an exemplary embodiment of the present invention is inserted into the screw rod, and the connection shaft rotates to engage shaft protrusions with screw grooves.

FIG. 6A is an enlarged view illustrating a state that the connection shaft of the lifting jack for automotive according to an exemplary embodiment of the present invention is inserted into the screw rod, and the connection shaft rotates to engage shaft protrusions with screw grooves, FIG. 6B is a cross-sectional view illustrating a state that the connection shaft of the lifting jack for automotive according to an exemplary embodiment of the present invention is inserted into the screw rod, and the connection shaft rotates to engage shaft protrusions with screw grooves, and FIG. 6C is an enlarged view illustrating a state that the connection shaft of the lifting jack for automotive according to an exemplary embodiment of the present invention is inserted into the screw rod, and the connection shaft rotates to engage shaft protrusions with screw grooves.

Referring to FIG. 6A to FIG. 6C, in a state that the connection shaft 160 of the lifting jack 100 for automotive vehicle is inserted into the internal circumference of the screw rod 150, the base 110 and the stand 120 are further remote from each other than the state illustrated in FIG. 5A.

The connection shaft 160 rotates in state that the connection shaft 160 of the lifting jack 100 for automotive is inserted into the internal circumference of the screw rod 150. The connection shaft hole 165 may be provided at the end portion of the connection shaft 160, and the user may rotate the connection shaft hole 165 by hands or by use of a tool including a wrench inserted into the connection shaft hole 165.

When the connection shaft 160 rotates, the shaft protrusions provided at the external circumference of the connection shaft 160 may be engaged with the screw grooves 152 provided at the internal circumference of the screw rod 150. As shown in FIG. 6B and FIG. 6C, the connection shaft 160 rotates in a direction which is vertical to lengthwise direction of the connection shaft 160, which is counterclockwise direction, so that the shaft protrusions 162 are inserted into and engaged with the screw grooves 152. At this time, the connection shaft 160 may be rotate by about 25 to 35 degrees with respect the screw grooves 152.

Figure 7A:
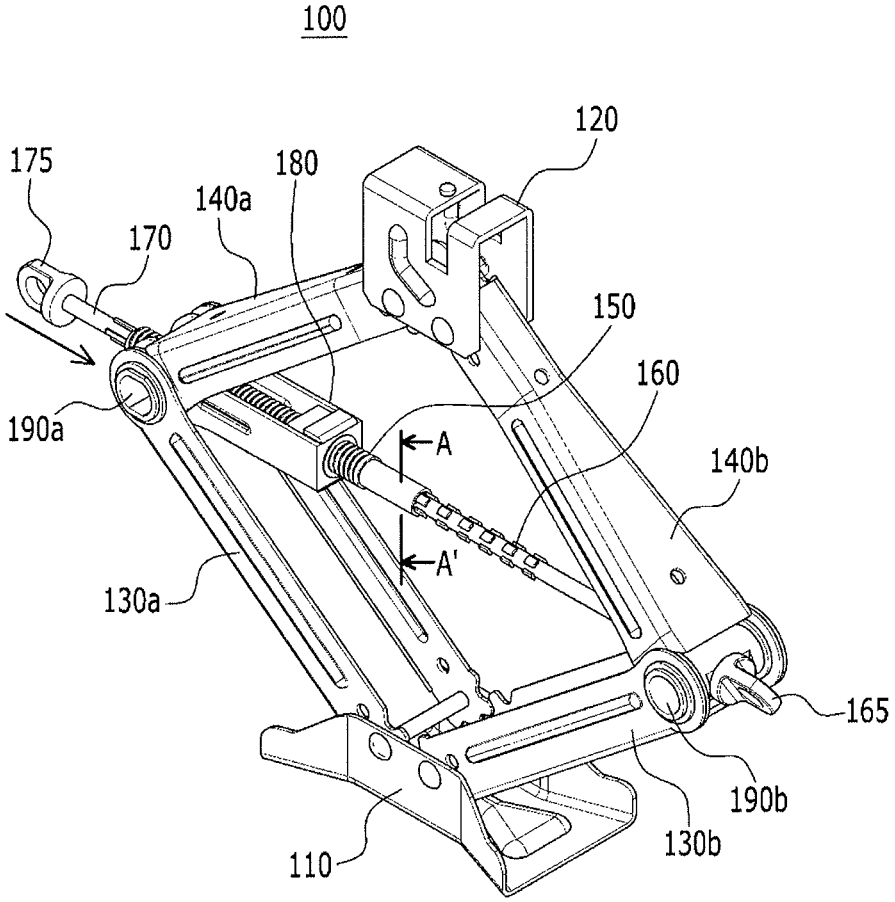
FIG. 7A is a drawing illustrating a state that the connection shaft of the lifting jack for automotive according to an exemplary embodiment of the present invention is inserted into the screw rod, and the key is inserted into the screw rod.
Figure 7B:
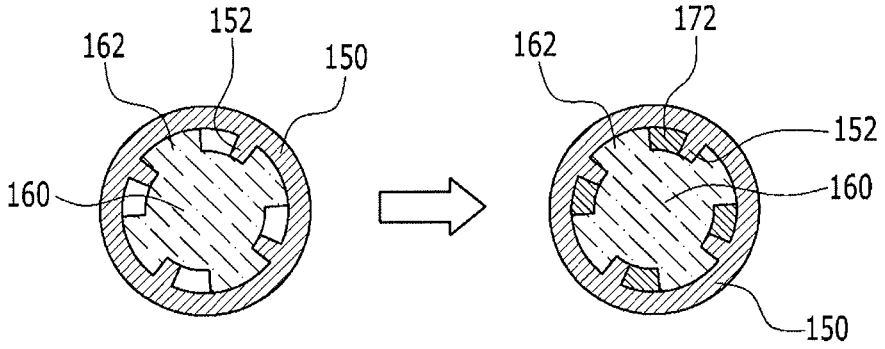
FIG. 7B is a cross-sectional view illustrating a state that the connection shaft of the lifting jack for automotive according to an exemplary embodiment of the present invention is inserted into the screw rod, and the key is inserted into the screw rod.
Figure 7C:
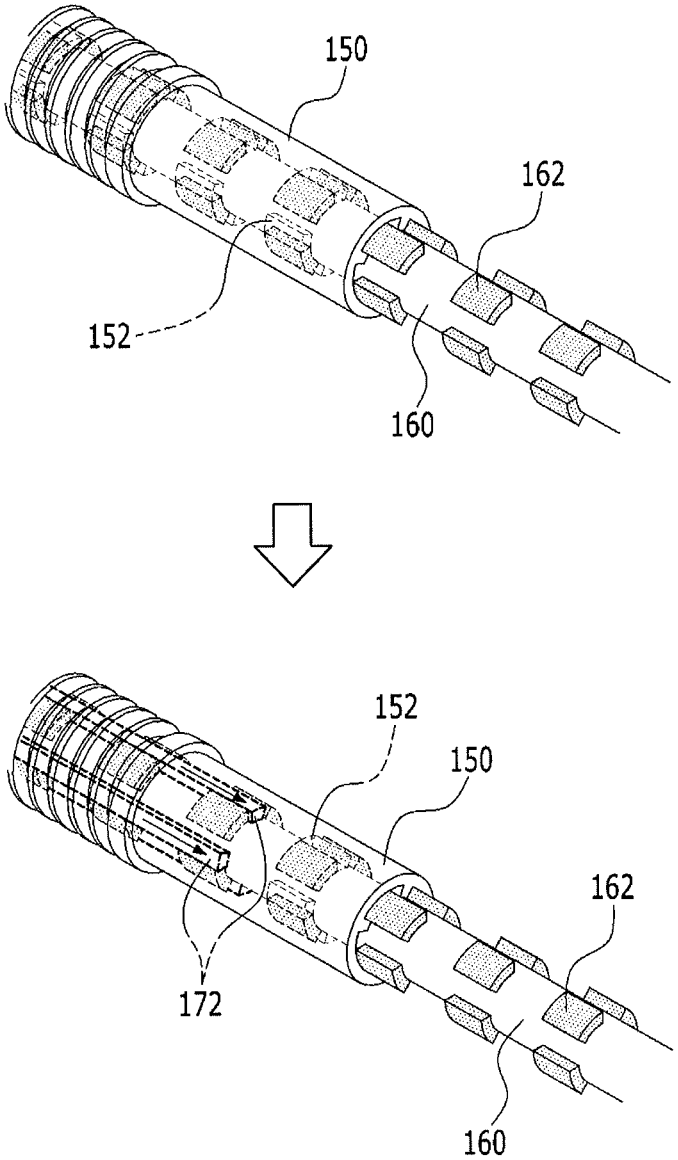
FIG. 7C an enlarged view illustrating a state that the connection shaft of the lifting jack for automotive according to an exemplary embodiment of the present invention is inserted into the screw rod, and the key is inserted into the screw rod.

FIG. 7A is a drawing illustrating a state that the connection shaft of the lifting jack for automotive according to an exemplary embodiment of the present invention is inserted into the screw rod, and the key is inserted into the screw rod, FIG. 7B is a cross-sectional view illustrating a state that the connection shaft of the lifting jack for automotive according to an exemplary embodiment of the present invention is inserted into the screw rod, and the key is inserted into the screw rod, and FIG. 7C an enlarged view illustrating a state that the connection shaft of the lifting jack for automotive according to an exemplary embodiment of the present invention is inserted into the screw rod, and the key is inserted into the screw rod.

Referring to FIG. 7A to FIG. 7C, in a state that the connection shaft 160 is inserted into the screw rod 150 and the connection shaft 160 rotates to make the shaft protrusions 162 to be inserted into the screw grooves 152, the key 170 is inserted into the screw rod 150 from the side of the fix bracket 180.

Key protrusions 172 are provided at the external circumference of the key 170, and the key protrusions 172 are inserted into the vacant space, which is space between the shaft protrusions 162, after the shaft protrusions 162 are inserted into the screw grooves 152. As shown in FIG. 7B and FIG. 7C, the key protrusions 172 are inserted between the shaft protrusions 162, therefore the connection shaft 160 may be tightly fixed at the internal circumference of the screw rod 150 without vacant space in a cross-sectional view.

Figure 8A:
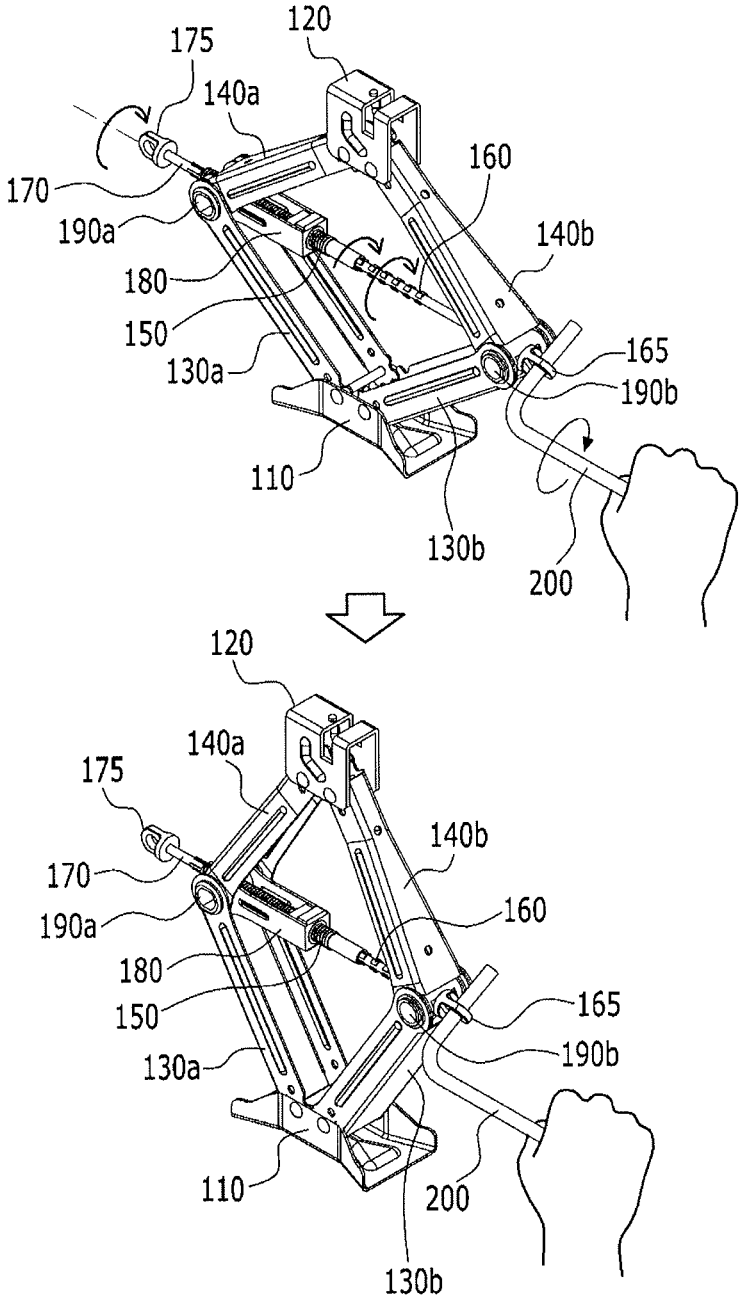
FIG. 8A is a drawing illustrating a state that the key of the lifting jack for automotive according to an exemplary embodiment of the present invention is inserted into the screw rod, and the connection shaft rotates and the base and the stand are remote from each other.
Figure 8B:
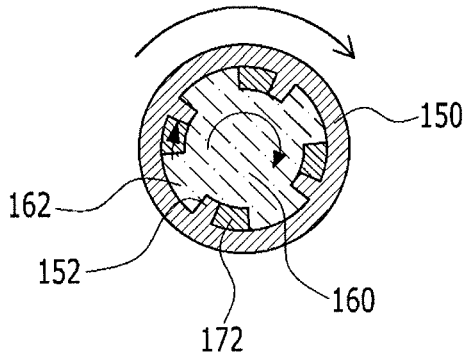
FIG. 8B is a cross-sectional view illustrating a state that the key of the lifting jack for automotive according to an exemplary embodiment of the present invention is inserted into the screw rod, and the connection shaft rotates and the base and the stand are remote from each other.
Figure 8C:
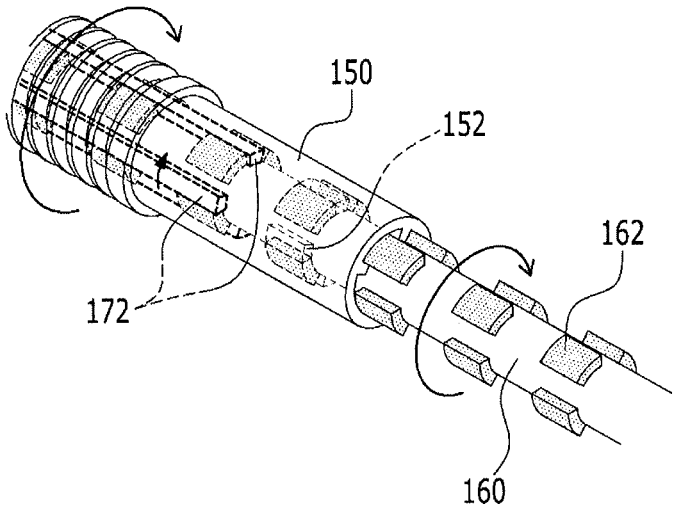
FIG. 8C is an enlarged view illustrating a state that the key of the lifting jack for automotive according to an exemplary embodiment of the present invention is inserted into the screw rod, and the connection shaft rotates and the base and the stand are remote from each other.

FIG. 8A is a drawing illustrating a state that the key of the lifting jack for automotive according to an exemplary embodiment of the present invention is inserted into the screw rod, and the connection shaft rotates and the base and the stand are remote from each other, FIG. 8B is a cross-sectional view illustrating a state that the key of the lifting jack for automotive according to an exemplary embodiment of the present invention is inserted into the screw rod, and the connection shaft rotates and the base and the stand are remote from each other, and FIG. 8C is an enlarged view illustrating a state that the key of the lifting jack for automotive according to an exemplary embodiment of the present invention is inserted into the screw rod, and the connection shaft rotates and the base and the stand are remote from each other.

Referring to FIG. 8A to FIG. 8C, in a state that the connection shaft 160 rotates in a direction which is vertical to lengthwise direction of the connection shaft 160 so that the screw grooves 152 and the shaft protrusions 162 are engaged with each other, the key 170 is inserted into the screw rod 150 through the fix bracket 180. At this time, the connection shaft 160 is fixed at the internal circumference of the screw rod 150, and the connection shaft 160 may be rotated by inserting the wrench 200 into the connection hole 165 provided at the end portion of the connection shaft 160 to rotate the wrench 200.

The base 110 and the stand 120 are remote from each other by rotating the connection shaft 160 in an opposite direction to rotation direction which the screw grooves 152 and the shaft protrusions 162 are engaged with each other, which is clockwise direction thereof. Accordingly, the automotive supported by the stand 120 may be lifted.

Also, the base 110 and the stand 120 may be remote from each other by rotating the key 170 in an opposite direction to rotation direction which the screw grooves 152 and the shaft protrusions 162 are engaged with each other, which is clockwise direction thereof. Key hole 175 may be provided at the end portion of the key 170, and the key 170 may rotate by inserting the wrench 200 into the key hole 175 and rotating the wrench 200.

Figure 9:
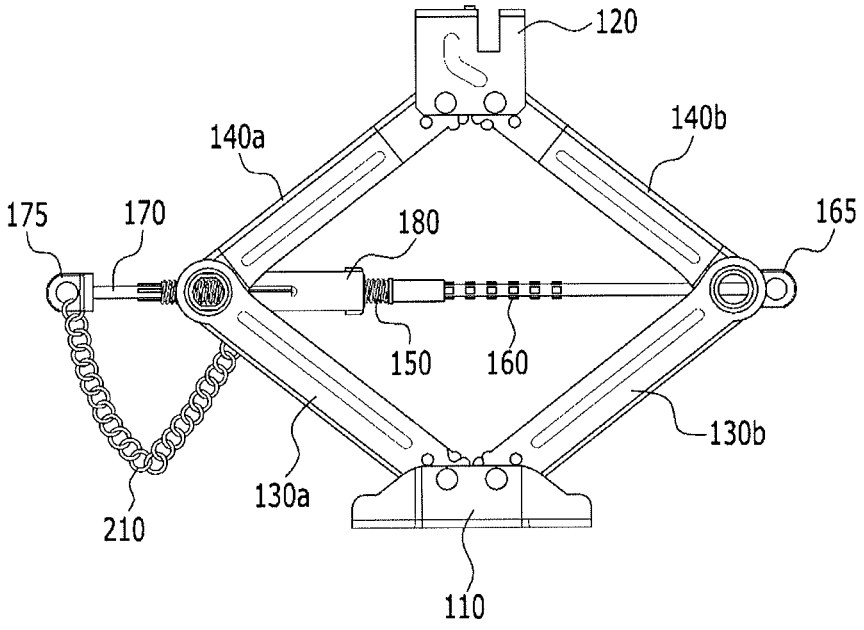
FIG. 9 is a drawing illustrating a state that the key of the lifting jack for automotive according to an exemplary embodiment of the present invention and the fix bracket are connected to each other by a chain.

FIG. 9 is a drawing illustrating a state that the key of the lifting jack for automotive according to an exemplary embodiment of the present invention and the fix bracket are connected to each other by a chain.

As shown in FIG. 9, the key hole 175 and the fix bracket 180 may be connected to each other by a chain 210 so that the key 170 may not be separated from the lifting jack 100 for automotive according to an exemplary embodiment of the present invention. The chain 210 may connect the key hole 175 with the lower arm 130*a,* or with the upper arm 140*a*.

As describe above, various aspects of the present invention are directed to providing a lifting jack for automotive including a connection shaft and a key slidably inserted respectively into both sides of a screw rod to be combined and released so that may ascend and descend the automotive by less effort and time.

While this invention has been described with reference to what is presently considered to be practical exemplary embodiments, it is to be understood that the invention is not limited to the included exemplary embodiments. On the contrary, it is intended to cover various modifications and equivalent claims as well as various alternatives and modifications thereof. It is intended that the scope of the invention be defined by the Claims appended hereto and their equivalents."

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A lifting jack for an automotive, comprising:

a base;

a pair of lower arms of which a first end portion is pivotally engaged with a first side and a second side of the base;

a stand having a stand groove;

a pair of upper arms of which a first end portion is pivotally engaged with a first side and a second side of the stand and a second end portion is pivotally engaged with a second end portion of the pair of lower arms;

a fix bracket pivotally engaged with the second end portion of one of the pair of lower arms and the second end portion of one of the pair of upper arms;

a hollow screw rod penetrating and being inserted into the fix bracket wherein screw threads are provided on an external circumference thereof;

a connection shaft inserted into an internal circumference of the screw rod; and a key inserted into the screw rod through the fix bracket wherein the connection shaft is inserted into and fixed at the internal circumference of the screw rod.

2. The lifting jack for the automotive of claim 1, wherein the second end portion of the pair of lower arms is pivotally engaged with an external side of the second end portion of the pair of upper arms.

3. The lifting jack for the automotive of claim 1, wherein the fix bracket is pivotally engaged with an internal side of one of the pair of upper arms.

4. The lifting jack for the automotive of claim 1, wherein screw grooves are provided at the internal circumference of the screw rod.

5. The lifting jack for the automotive of claim 4, wherein shaft protrusions engaged with the screw grooves are provided at an external circumference of the connection shaft.

6. The lifting jack for the automotive of claim 5, wherein the connection shaft rotates in a direction which is vertical to a lengthwise direction of the connection shaft wherein the screw grooves and the shaft protrusions are engaged with each other.

7. The lifting jack for the automotive of claim 6, wherein key protrusions are provided at an external circumference of the key, and the key protrusions are inserted between and engaged with the shaft protrusions.

8. The lifting jack for the automotive of claim 7, wherein the key is inserted into the screw rod through the fix bracket in state that the key rotates in a direction vertical to a lengthwise direction of the connection shaft and the screw grooves and the shaft protrusions are engaged with each other.

9. The lifting jack for the automotive of claim 8, wherein the base and the stand are remote from each other by rotating the connection shaft in an opposite direction to rotation direction which the screw grooves and the shaft protrusions are engaged with each other.

10. The lifting jack for the automotive of claim 8, wherein the base and the stand are remote from each other by rotating the key in an opposite direction to a rotation direction which the screw grooves and the shaft protrusions are engaged with each other.

11. The lifting jack for the automotive of claim 8, wherein a key hole is provided at an end portion of the key in an opposite direction to a direction which the key is inserted into the screw rod.

12. The lifting jack for the automotive of claim 11, wherein the key rotates by inserting a wrench into the key hole and rotating the wrench.

13. The lifting jack for the automotive of claim 11, wherein the key hole and the fix bracket are connected to each other by a chain.

14. The lifting jack for the automotive of claim 6, wherein a connection shaft hole is provided at an end portion of the connection shaft in an opposite direction to a direction which the connection shaft is inserted into the internal surface of the screw rod.

15. The lifting jack for the automotive of claim 14, wherein the connection shaft rotates by inserting a wrench into the connection shaft hole and rotating the wrench.

* * * * *